US008298037B2

(12) United States Patent
Sip

(10) Patent No.: US 8,298,037 B2
(45) Date of Patent: Oct. 30, 2012

(54) TOY EYE

(75) Inventor: Kim-Yeung Sip, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei ( * ) Notice: Subject to any disclaimer, the term of this patent is extended or adjusted under 35 U.S.C. 154(b) by 696 days.

(21) Appl. No.: 12/503,828

(22) Filed: Jul. 15, 2009

(65) Prior Publication Data

US 2010/0056019 A1 Mar. 4, 2010

(30) Foreign Application Priority Data

Aug. 26, 2008 (CN) ..... 2008 1 0304194

(51) Int. Cl.
*A63H 3/38* (2006.01)

(52) U.S. Cl. ..... 446/392; 446/343; 446/344; 446/345; 446/347; 446/348; 446/389; 623/4.1; 623/6.64

(58) Field of Classification Search ..... 446/343, 446/344, 345, 347, 348, 389, 392; 623/4.1, 623/6.64
See application file for complete search history.

(56) References Cited

U.S. PATENT DOCUMENTS

| | | | | | |
|---|---|---|---|---|---|
| 1,760,318 | A | * | 5/1930 | Poore | 446/341 |
| 2,022,286 | A | * | 11/1935 | Beulah | 446/341 |
| 2,098,166 | A | * | 11/1937 | Rubenstein | 446/337 |
| 2,136,006 | A | * | 11/1938 | Fisher | 40/416 |
| 2,619,772 | A | * | 12/1952 | Dikszas | 446/392 |
| 2,854,788 | A | * | 10/1958 | Baggott | 446/183 |
| 2,856,730 | A | * | 10/1958 | Bashover | 446/346 |
| 2,922,253 | A | * | 1/1960 | Carter | 446/303 |
| 3,383,793 | A | * | 5/1968 | Bonanno | 446/130 |
| 3,432,963 | A | * | 3/1969 | Brudney | 446/346 |
| 3,492,760 | A | * | 2/1970 | Tatsuro | 446/130 |
| 3,616,572 | A | * | 11/1971 | Kosicki et al. | 446/346 |
| 3,660,932 | A | * | 5/1972 | Raffeli et al. | 446/346 |
| 3,905,130 | A | * | 9/1975 | Gordon et al. | 434/271 |
| 4,332,039 | A | * | 6/1982 | LaFuente | 623/6.64 |
| 4,507,099 | A | * | 3/1985 | Kinberg | 446/389 |
| 4,737,132 | A | * | 4/1988 | Shunsaku | 446/348 |
| 4,761,150 | A | * | 8/1988 | Lautenberger et al. | 446/345 |
| 4,773,889 | A | * | 9/1988 | Rosenwinkel et al. | 446/448 |

(Continued)

FOREIGN PATENT DOCUMENTS

GB 1392431 A * 4/1975

*Primary Examiner* — Gene Kim
*Assistant Examiner* — Alexander Niconovich
(74) *Attorney, Agent, or Firm* — Altis Law Group, Inc.

(57) ABSTRACT

A toy eye includes a casing having a transparent top portion, a lens defining a through hole, and a pupil received in through hole of the lens. The lens and the pupil are both made of soft resilient material, and clung to the transparent top portion of the casing. The toy eye also includes a push-pull element for pushing the pupil towards the transparent top portion of the casing or pulling the pupil reversely. The toy eye further includes a light processing element for sensing the change of the outside light intensity and generating a driving signal when the value of the change of the light intensity reaches or exceeds a predetermined value, and a driving element for driving the push-pull element to push or pull the pupil, upon receiving the driving signal from the light processing element.

10 Claims, 5 Drawing Sheets

U.S. PATENT DOCUMENTS 4,777,938 A * 10/1988 Sirota ..... 600/27
4,828,531 A * 5/1989 Kuhn ..... 446/392
5,108,427 A * 4/1992 Majercik et al. ..... 623/5.12
5,281,183 A * 1/1994 Bernhardt et al. ..... 446/345
5,501,627 A * 3/1996 Ekstein ..... 446/175
5,769,687 A * 6/1998 Ko ..... 446/343
5,782,669 A * 7/1998 Hornsby et al. ..... 446/342
5,900,923 A * 5/1999 Prendergast et al. ..... 351/221
5,919,227 A * 7/1999 Bello ..... 623/6.64
5,951,363 A * 9/1999 Uetake ..... 446/470
6,220,923 B1 * 4/2001 Lin ..... 446/392
6,391,057 B1 * 5/2002 Schleipman et al. ..... 623/6.64
6,776,681 B2 * 8/2004 Willett ..... 446/300
6,776,683 B1 * 8/2004 Lin ..... 446/392
6,988,927 B2 * 1/2006 Gingold et al. ..... 446/175
7,234,989 B2 * 6/2007 Maddocks et al. ..... 446/392
7,322,874 B2 * 1/2008 Ellman et al. ..... 446/345
7,485,025 B2 * 2/2009 Schnuckle ..... 446/392
7,641,535 B2 * 1/2010 Maddocks et al. ..... 446/392
7,988,521 B2 * 8/2011 Lai ..... 446/301
7,988,523 B2 * 8/2011 Chang et al. ..... 446/392
8,083,567 B2 * 12/2011 Su ..... 446/392
8,083,794 B2 * 12/2011 Liu ..... 623/6.64
8,162,714 B2 * 4/2012 Yang ..... 446/392
2002/0049023 A1 * 4/2002 Simeray ..... 446/392
2004/0214507 A1 * 10/2004 Maddocks et al. ..... 446/392
2005/0287913 A1 * 12/2005 Ellman et al. ..... 446/384
2007/0010163 A1 * 1/2007 Maddocks et al. ..... 446/392
2007/0254554 A1 * 11/2007 Ellman et al. ..... 446/337
2008/0102729 A1 * 5/2008 Ekstein-Lieberman ..... 446/297
2008/0139082 A1 * 6/2008 Schnuckle ..... 446/392
2009/0318057 A1 * 12/2009 Sip et al. ..... 446/392
2010/0029171 A1 * 2/2010 Su ..... 446/392
2010/0120326 A1 * 5/2010 Lai ..... 446/343

* cited by examiner

TOY EYE

BACKGROUND

1. Technical Field

The disclosure relates to toy devices and, particularly, to a toy eye.

2. Description of Related Art

Nowadays, pupils of toy eyes can rotate from right to left or from left to right. However, pupils of toy eyes cannot dilate or contract when ambient light changes, to simulate real eyes.

BRIEF DESCRIPTION OF THE DRAWINGS

The components of the drawings are not necessarily drawn to scale, the emphasis instead being placed upon clearly illustrating the principles of a toy eye. Moreover, in the drawings, like reference numerals designate corresponding portions throughout several views.

DETAILED DESCRIPTION

Figure 1:
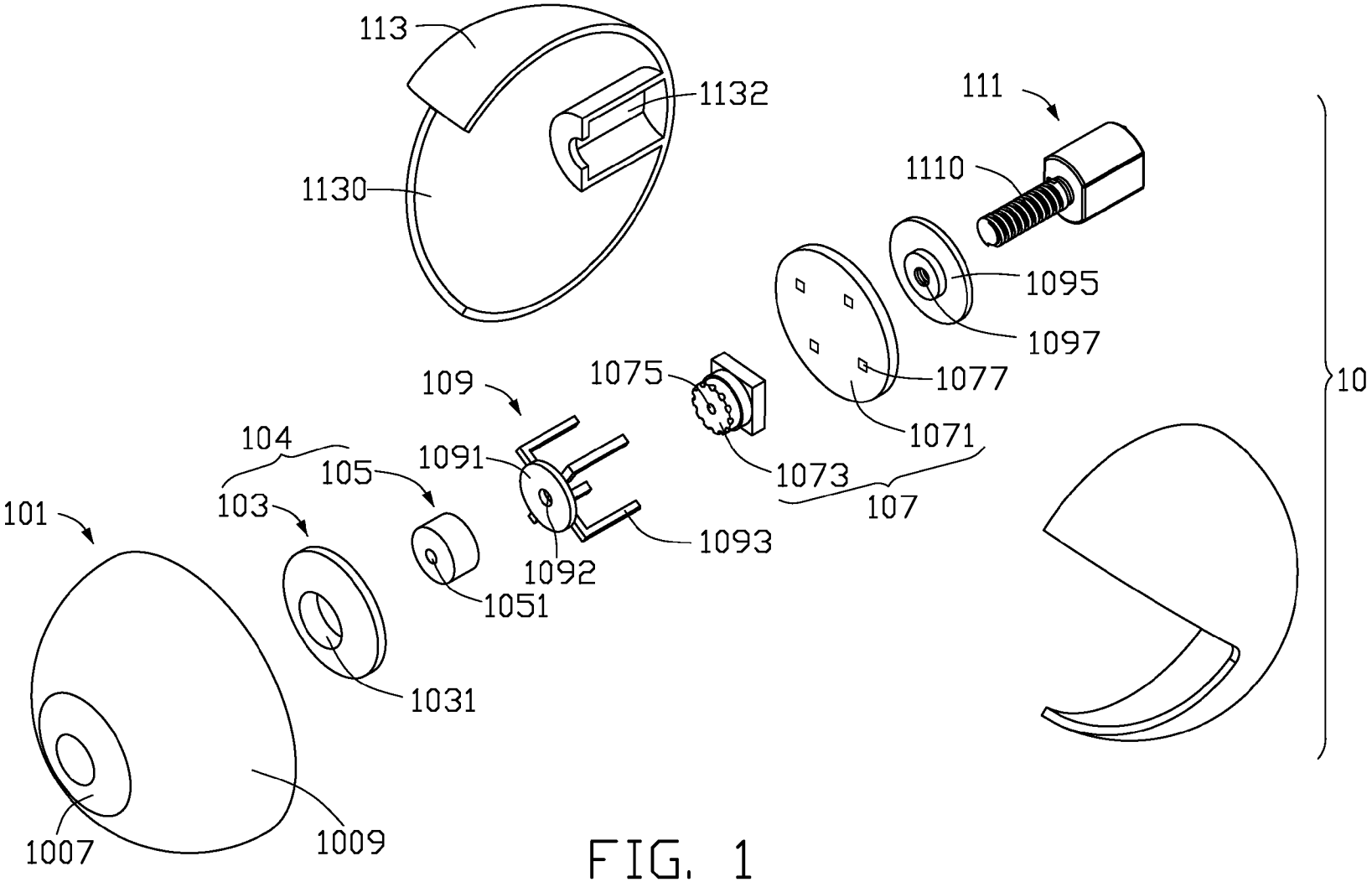
FIG. 1 is an exploded perspective view of a toy eye in accordance with an exemplary embodiment.
Figure 2:
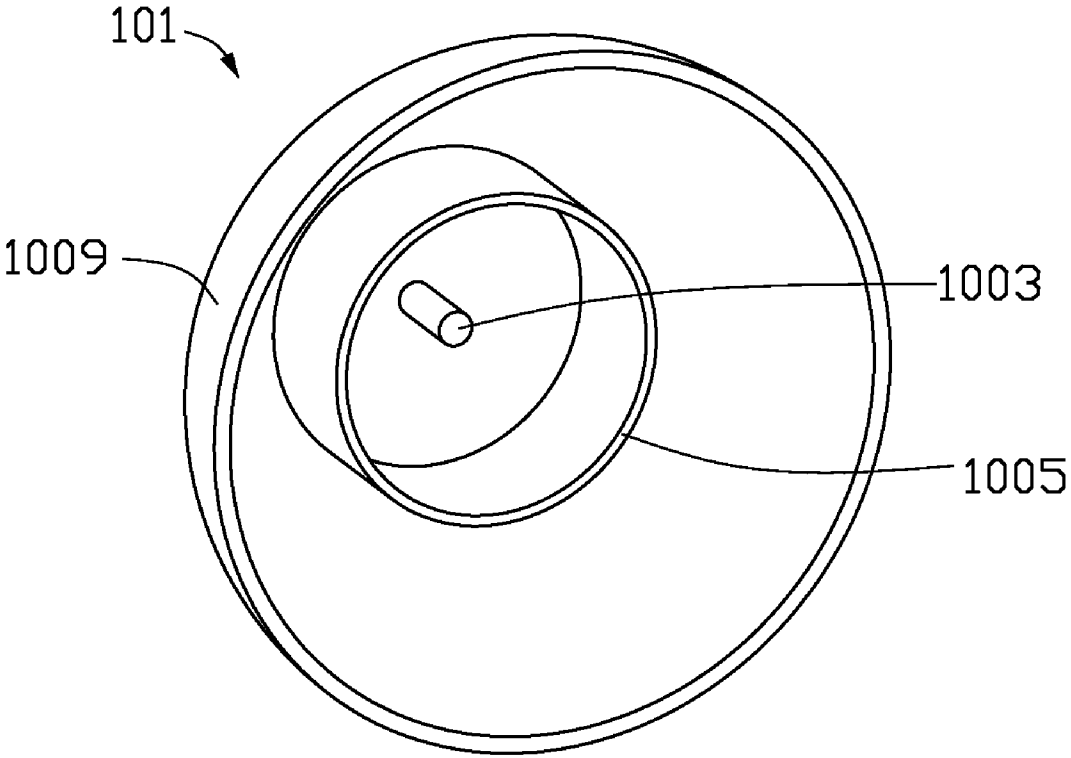
FIG. 2 is an isometric view of a front casing of the toy eye of FIG. 1.

Referring to FIGS. 1-2, a toy eye 10 includes a front casing 101, and a rear casing 113. The front casing 101 and the rear casing 113 are coupled together to form an interior space for receiving an eyeball 104, a light processing element 107, a push-pull element 109, and a driving element 111. The eyeball 104 is used to simulate various kinds of eyes such as human eyes. The light processing element 107 is used to sense the change of the outside light intensity and generate a driving signal when the value of the change of the sensed light intensity reaches or exceeds a predetermined value. The driving element 111 is used to drive the push-pull element 109 to push or pull the eyeball 104, causing the eyeball 104 to dilate or contract, upon receiving the driving signal from the light processing element 107.

The front casing 101 is generally bowl-shaped including a top portion 1007 and a convex body 1009. The top portion 1007 of the front casing 101 is made of transparent material, and the convex body 1009 is made of white material for simulating the white portion of an eye. A circular wall 1005 protrudes from the inner surface of the front casing 101 aligned with periphery of the top portion 1007. The eyeball 104 is received in the circular wall 1005 and visible through the top portion 1007. A light conductor 1003 of the light processing element 107 is located within the circular wall 1005 to conduct outside light to a light sensor 1073 of the light processing element 107.

An opening 1130 is defined in the rear casing 113. The convex body 1009 of the front casing 101 is partially received in the rear casing 113 through the opening 1130. A bracket 1132 protrudes from the inner surface of the rear casing 113 for supporting the driving element 111.

The eyeball 104 includes a lens 103 representing the iris of the eyeball 104 and a pupil 105. A first through hole 1031 is defined in the lens 103 for receiving the pupil 105. Both the lens 103 and the pupil 105 are clung to the inner surface of the top portion 1007 of the front casing 101. The lens 103 and the pupil 105 are both made of soft resilient material. In the exemplary embodiment, the lens 103 and the pupil 105 are both made of silica gel material. A second through hole 1051 is defined in the pupil 105. The light conductor 1003 penetrates through the second through hole 1051 and finally reaches the light sensor 1073.

The push-pull element 109 includes a connecting panel 1095, a push-pull panel 1091, and a plurality of legs 1093 formed along the fringe of the push-pull panel 1091. The pupil 105 may be adhered to the push-pull panel 1091 using adhesive. A third through hole 1092 is defined in the push-pull panel 1091 and a threaded through hole 1097 is defined in the connecting panel 1095. A fourth through hole 1075 is defined in the light sensor 1073 of the light processing element 107. The light processing element 107 further includes a circuit board 1071 and a plurality of fifth through holes 1077 are defined in the circuit board 1071. The legs 1093 pass through the fifth through holes 1077 and may be adhered to the connecting panel 1095 using adhesive. The light conductor 1003 extends through the second through hole 1051, the third through hole 1092, and the fourth through hole 1075 in sequence to finally reach the light sensor 1073.

The driving element 111 includes a threaded shaft 1110 engaged with the threaded through hole 1097 of the connecting panel 1095. When the circuit board 1071 determines the change value of the sensed light intensity reaches or exceeds a predetermined value, the driving element 111 drives the push-pull panel 1091 to push or pull the pupil 105. In the exemplary embodiment, the driving element 111 is a linear motor.

Figure 3:
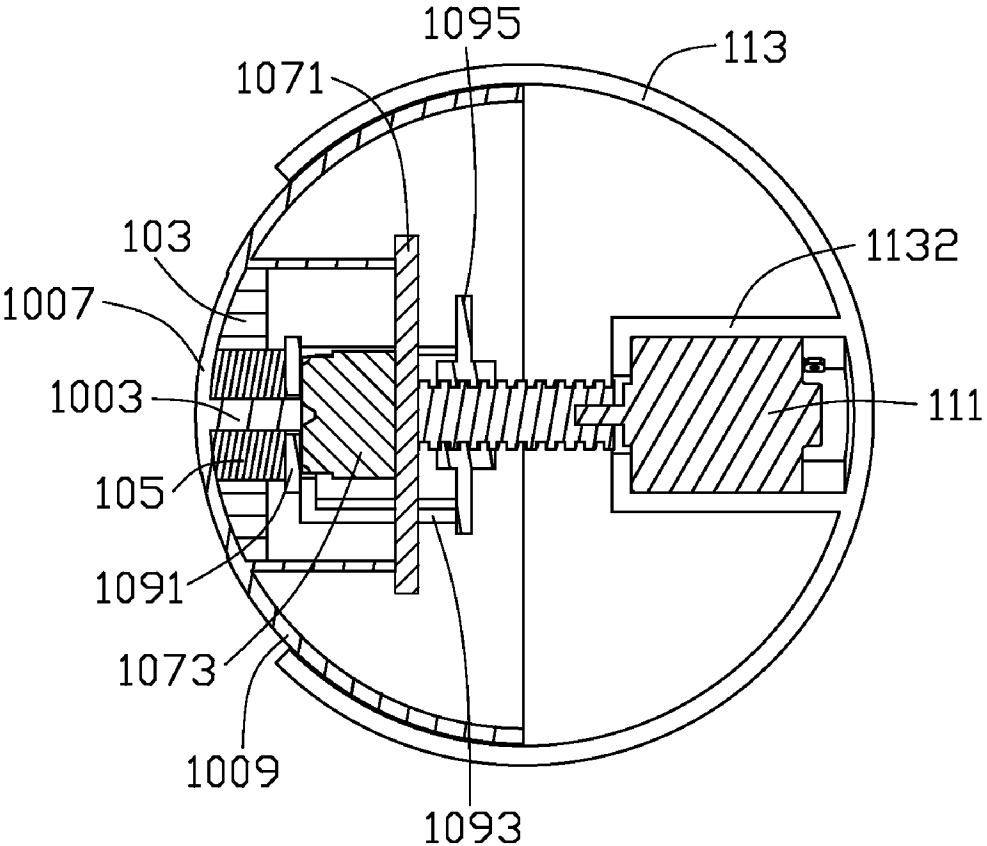
FIG. 3 is a cross-sectional perspective view of the toy eye of FIG. 1, the pupil of the toy eye is in a natural state.
Figure 4:
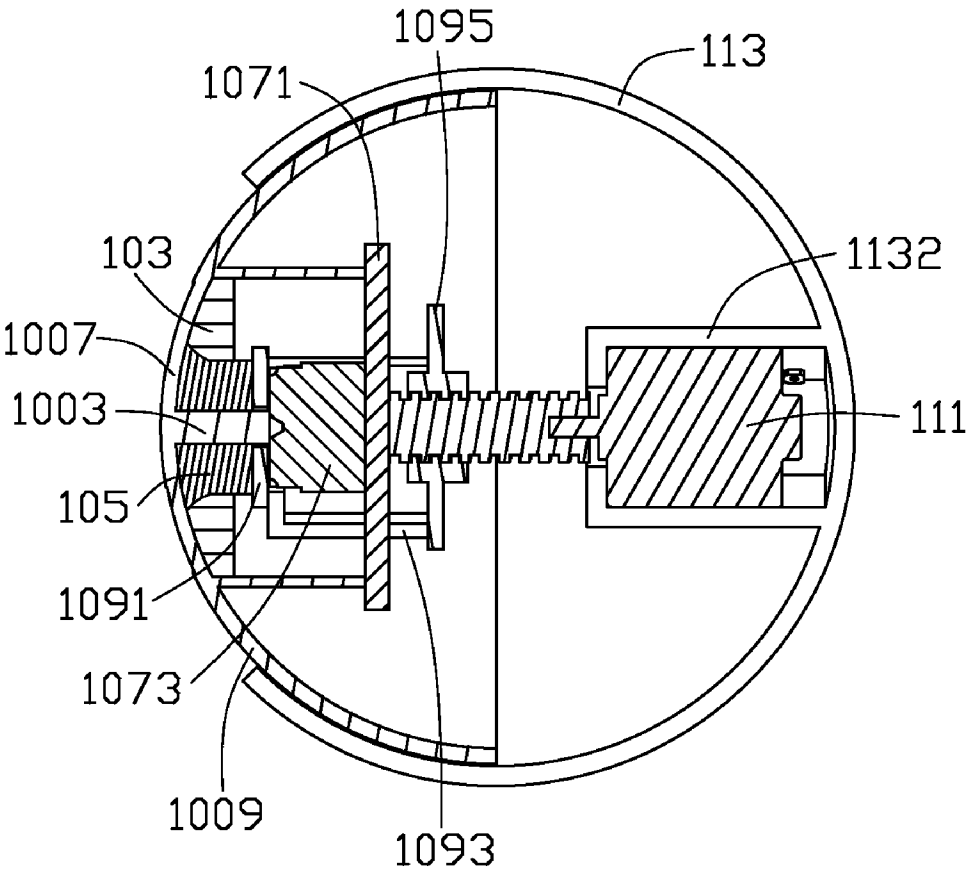
FIG. 4 is a cross-sectional perspective view of the toy eye of FIG. 1, with the pupil dilated.
Figure 5:
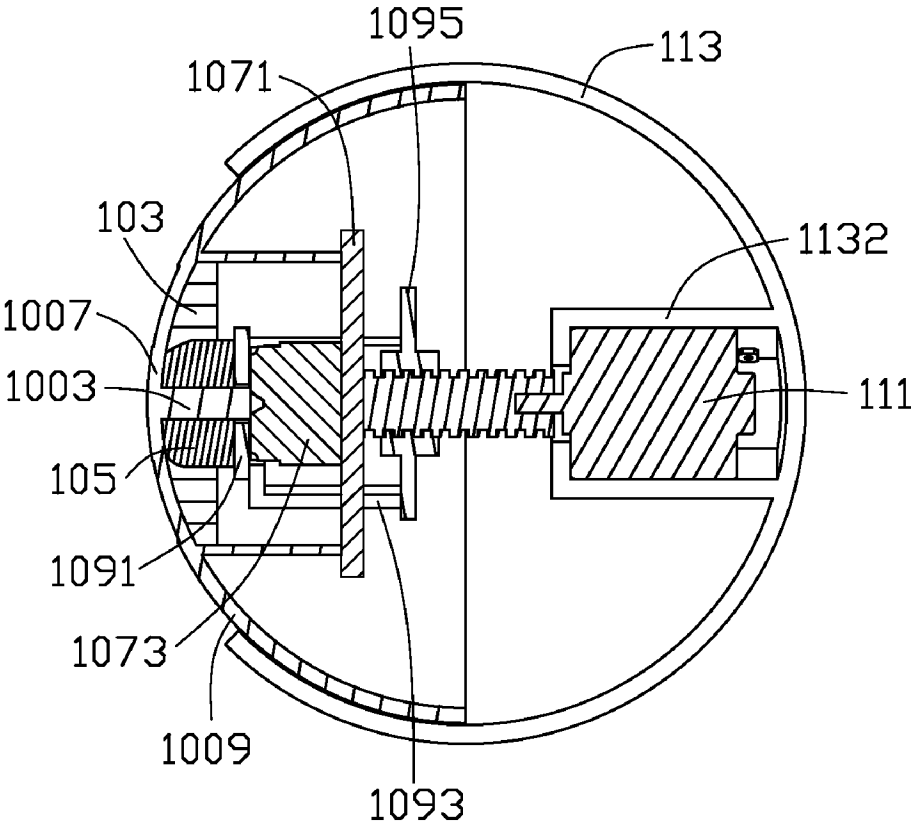
FIG. 5 is a cross-sectional perspective view of the toy eye of FIG. 1, with the pupil contracted.

Referring to FIGS. 3, 4, and 5, in FIG. 3, the lens 103 and the pupil 105 are both in a natural state, that is, the lens 103 and the pupil 105 are both in a non-transmutable state. In FIG. 4, when the circuit board 1071 determines the value of the change of the sensed light intensity reaches or exceeds a first predetermined value, the circuit board 1071 generates a driving signal. The driving element 111 drives the push-pull panel 1091 to push the pupil 105 for a first predetermined time interval, upon receiving the driving signal from the circuit board 1071. When the pupil 105 is pushed, the lens 103 is pressed by the pupil 105, therefore, the contact area of the lens 103 and the top portion 1007 decreases, and the contact area of the pupil 105 and the top portion 1007 increases. The pupil 105 is dilated. In FIG. 5, when the circuit board 1071 determines the value of the change of the sensed outside light intensity reaches or exceeds a second predetermined value, the circuit board 1071 generates another driving signal. The driving element 111 drives the push-pull panel 1091 to pull the pupil 105 for a second predetermined time interval, upon receiving the driving signal. The pupil 105 is squeezed by the lens 103 when the push-pull panel 1091 pulls the pupil 105, therefore, the contact area of the lens 103 and the top portion 1007 increases, and the contact area of the pupil 105 and the top portion 1007 decreases. The pupil 105 is contracted.

It should be noted that when the pupil 105 is in a dilated state or in a contracted state, the driving element 111 pulls or pushes the pupil 105, causing the pupil 105 to regain its natural state, when the circuit board 1071 determines the value of the change of the sensed light intensity reaches or exceeds a predetermined value which is for causing the pupil 105 to regain its natural state.

Although the present disclosure has been specifically described on the basis of the exemplary embodiment thereof, the disclosure is not to be construed as being limited thereto.

Various changes or modifications may be made to the embodiment without departing from the scope and spirit of the disclosure.

What is claimed is:

1. A toy eye comprising:

a casing having a transparent top portion;

a lens defining a through hole;

a pupil received in the through hole of the lens, wherein the lens and the pupil are both made of soft resilient material, and clung to the transparent top portion of the casing;

a push-pull element for pushing the pupil towards the transparent top portion of the casing or pulling the pupil reversely;

a light processing element for sensing the change of the outside light intensity and generating a driving signal when the value of the change of the light inten sity reaches or exceeds a predetermined value; and a driving element for driving the push-pull element to push or pull the pupil, upon receiving the driving signal from the light processing element, wherein:

when the driving element drives the push-pull element to push the pupil toward the top portion of the casing, a contact area between the pupil and the top portion increase, and a contact area between the lens and the top portion decreases as the lens being pressed by the pupil, thereby simulating a dilated pupil; and when the driving element drives the push-pull element to pull the pupil away from the top portion of the casing, the contact area between the lens and the top portion increases, and the contact area between the pupil and the top portion decrease as the pupil being squeezed by the lens, thereby simulating a contracted pupil.

2. The toy eye as described in claim 1, wherein the lens and the pupil are made of silica gel material.

3. The toy eye as described in claim 1, wherein a circular wall protrudes from an inner surface of the casing, and the lens and the pupil are surrounded by the circular wall.

4. The toy eye as described in claim 3, wherein the light processing element comprises a light conductor protruding from an inner surface of the top portion, a circuit board attached to the circular wall, and a light sensor attached to a surface of the circuit board facing the top portion, the light conductor extends through the pupil to reach the light sensor for conducting the outside light to the light sensor, the light sensor is for sensing the change of the light intensity, and the circuit board is for generating a driving signal when the value of the change of the sensed light reaches or exceeds a predetermined value.

5. The toy eye as described in claim 4, wherein the light conductor is located within the circular wall.

6. The toy eye as described in claim 5, wherein the light conductor is received within the pupil.

7. The toy eye as described in claim 4, wherein the push-pull element comprises a connecting panel, a push-pull panel, and a plurality of legs formed along a fringe of the push-pull panel, the pupil is adhered to the push-pull panel using adhesive, and the legs pass through a plurality of through holes defined in the circuit board and are adhered to the connecting panel using adhesive.

8. The toy eye as described in claim 7, wherein the driving element comprises a threaded shaft and the connecting panel comprises a threaded through hole, the threaded shaft is engaged with the threaded through hole.

9. The toy eye as described in claim 1, wherein the casing comprises a front casing and a rear casing, the transparent top portion being formed on the front casing.

10. The toy eye as described in claim 9, wherein a bracket protrudes from an inner surface of the rear casing for supporting the driving element.

* * * * *